United States Patent [19]

Aguirregomezcorta

[11] Patent Number: 4,687,199

[45] Date of Patent: Aug. 18, 1987

[54] BASE BALL GAME

[76] Inventor: Enrique Aguirregomezcorta, 7555 SW. 29 St., Miami, Fla. 33155

[21] Appl. No.: 803,015

[22] Filed: Nov. 29, 1985

[51] Int. Cl.[4] ..... A63F 3/00; A63F 7/06; A63F 9/04

[52] U.S. Cl. ..... 273/93 R; 273/93 C; 273/145 C; 273/145 CA; 273/145 E

[58] Field of Search ..... 273/93 R, 93 A, 146, 273/145 C, 145 CA, 145 E; 116/222, 326

[56] References Cited

U.S. PATENT DOCUMENTS

| | | | |
|---|---|---|---|
| 812,048 | 2/1906 | Kirby | 273/93 C |
| 1,161,770 | 11/1915 | Hatfield | 273/93 C |
| 1,197,170 | 9/1916 | Aylesworth et al. | 273/93 R |
| 1,260,879 | 3/1918 | Dickenson | 273/93 R |
| 1,458,275 | 6/1923 | Cossitt | 273/93 R |
| 1,544,308 | 6/1925 | Gelpi | 273/93 R |
| 1,547,313 | 7/1925 | Foster | 273/93 C |
| 1,625,200 | 4/1927 | Franke et al. | 273/93 R |
| 1,684,189 | 9/1928 | Meyer | 273/93 C |
| 1,790,994 | 2/1931 | McCook | 116/326 |
| 2,215,261 | 9/1940 | Bishop et al. | 273/145 C |
| 2,812,181 | 11/1957 | Richman | 273/93 C |
| 3,528,661 | 9/1970 | Warner | 273/93 C |
| 4,378,115 | 3/1983 | Terrero | 273/93 C |
| 4,452,453 | 6/1984 | Daley et al. | 279/93 R |

FOREIGN PATENT DOCUMENTS

| | | | |
|---|---|---|---|
| 1383479 | 11/1964 | France | 273/145 C |
| 636368 | 4/1950 | United Kingdom | 273/145 E |

*Primary Examiner*—Paul E. Shapiro

[57] ABSTRACT

A board game wherein two participants or two teams with two or more participants each team, compete in moving a plurality of simulated baseball players, in a simulated baseball game, with the bases, first, second and third and the home plate with the batter position with a special plastic device with a die and a small ball inside and the pitcher position with a special plastic device with two dice inside, both devices are designed to make different moves in the game. Two groups of cards with regulations for the moves of the simulated baseball players in the game. A plurality of plastic pieces simulating the ball thrown by the pitcher. A plastic device for the umpires' decisions with a die inside used by the participants in the game.

3 Claims, 27 Drawing Figures

BASE BALL GAME

OBJECTS AND ADVANTAGES OF THE PRESENT INVENTION

One of the principal objects of the present invention is to provide a simulated BASEBALL GAME, for children or adults in which two participants or two teams with two or more participants each team, compete and try to make more runs than the other.

Once decided who will be the first to play (in this game it will be the VISITORS) this means the first team or participant in turn to bat. The participant or participants who represent the simulated teams (VISOTORS or HOME CLUB) and either one who at the end of the 9 innings accumulate more runs, will be the WINNER.

Another principal object of this invention is to provide two separate sets of dice, one with two dice, used inside the special plastic device (PITCHER) and the other set with one die and a small ball, both the small ball and the die, are used inside the special plastic device (BATTER).

Yet another object of this invention is to provide two special plastic devices, one in the pitcher position and one in the batter position (Home Plate) with some improvement inside that shake the two dice and the die and small ball in the special devices respectively, to have the numbers and colors for the moves in the game.

Another object of this invention is to provide a device for the Umpires' decisions, with a die inside with the words SAFE and OUT.

Another object of this invention is to provide a plurality of small circles, in line from the pitcher to the batter position in home plate, with the simulated baseball ball printed on each circle, they go inside of four elliptical figures with different colors.

Another object of this invention is to provide a plurality of small round plastic pieces, with numbers and simulating baseball balls, they go in the small circles, explained before.

A further object of this invention is to form the board game in a generally square configuration and the four side edges divided in spaces with printed figures of baseball players.

A further object of this invention is to provide four corner areas, home plate, first, second and third bases. The four corners could be painted with the same color, or four different colors. Each side edges between bases are divided in five equal spaces.

Another object of this invention is to provide the game participants with simulated baseball players.

Another object of this invention is to provide a game with two groups of cards, one with baseball player figures printed or maybe with real photos on one side and 4 different groups of moves on the other side of the card. The other group or set of cards has printed on one side of the card one move or play, like HIT, OUT, HOME RUN, etc. and on the other side 4 different moves or plays for the game.

A further object of this invention is to provide the game participants with a plurality of pins with a simulated baseball ball on one end and are used inserted in the game board, to mark the balls, outs, etc., of the game.

Another object of this invention is to provide the game participants with a simulated baseball ball, to indicate where the move or play is taken place in the game.

DETAILED DESCRIPTION OF THE INVENTION

Figure 1:
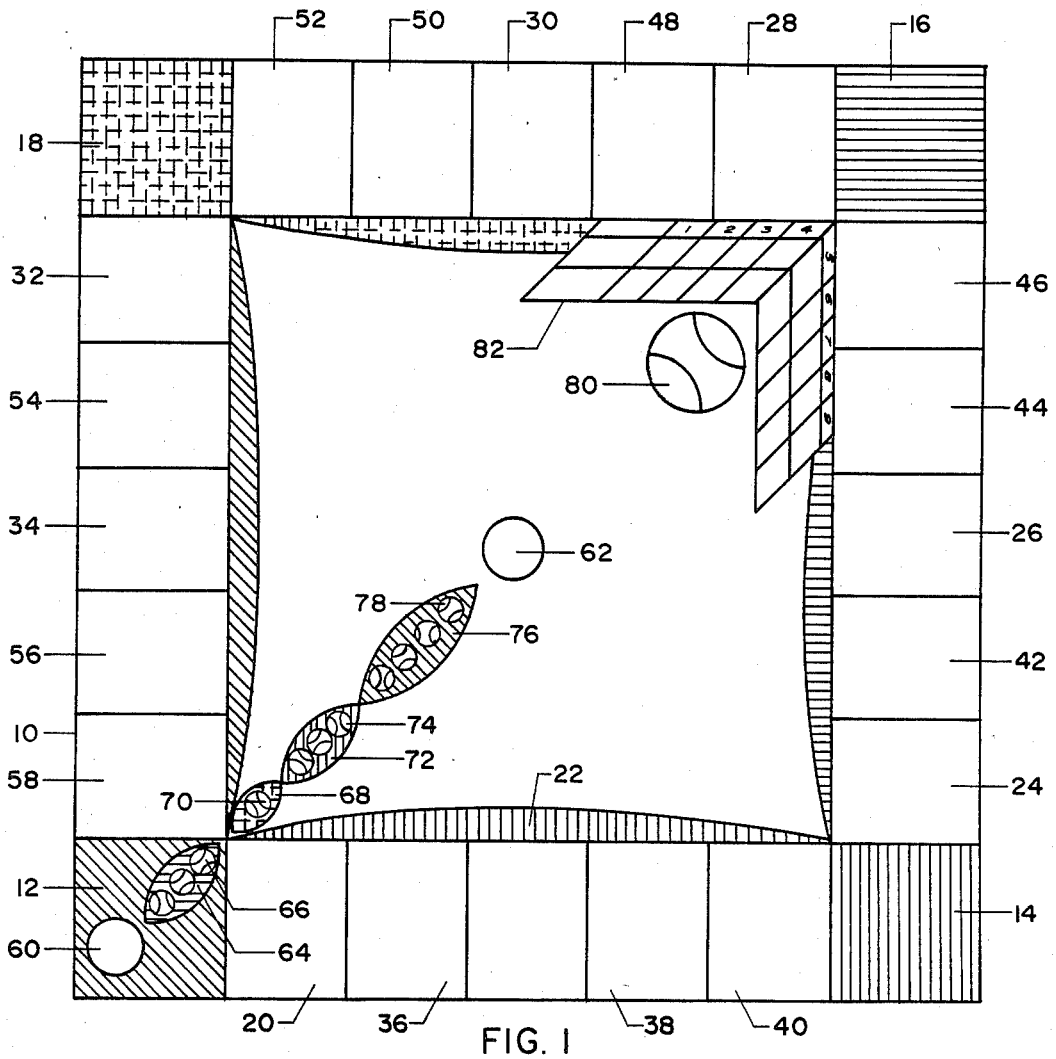
FIG. 1. A plan view of the game board of the present invention.

With reference to the drawings in which like reference numerals designate like or corresponding parts throughout the various views and with particular reference to FIG. 1, the numeral 10 generally designates the game board of the present invention. As illustrated, the game board 10, is preferably square in configuration. Three of the four corner portions are designated to be the bases of the simulated baseball game, first base 14, second base 16 and third base 18, respectively, the fourth corner is designated to be the home plate 12. Each of the four edge portions between two corners of the game board, are divided in five equal parts and same side of the corner areas; also each four inside edge portions are painted with four different colors, the same four colors of the base 102, in the special plastic device, FIG. 22. Each edge portion colors has one corner with same color, (this as explained before could be changed and use just one color for the four corners) starting with edge from home plate to first base will be red colored, including a first base, the second edge side will be blue, from first to second base including the second base, the third edge side from second to third base will be yellow, including the third base and the fourth edge side from third base to home plate will be green, including the home plate.

On each side of the game board (which are divided in five equal parts between two corners) we put the cards 90 and 92 and such spaces will be occupied in the following manner: starting from home plate 12, toward the first base 14, the first space 20, in this space the participants will put one card 90, with a word or move printed on one side of the card and 4 different moves for the game on the other side of the card. The set of cards 90 will have 8 cards, each one with one word or move printed on one side of the card (two with the word FOUL, two with OUT, one with HIT, one with 2B, one with 3B and one with HOME RUN) and 4 different moves for the game on the other side of the card.-

Next the second space 36, will have printed the figure of a baseball player, in this case a catcher, on this space a card 92, will be placed and will show on one side of the card a figure or a picture of a baseball player (catcher) and on the other side of the card it will shows 4 different groups and each one with 4 different moves or plays, related with the catcher. The set or group of cards 92 will have a plurality of cards, with pictures or figures of baseball players on one side of the cards and 4 different groups with 4 different moves or plays each group, as explained before, related with different baseball players of the game on the other side of the cards. The space that follows, the third space 22, will be for the cards 90, in this space will be printed the word FOUL and we put a card 90 with the word FOUL on one side and 4 different moves on the other side of the card. The fourth space 38, will be represented by the figure printed of a base-ball player, in this case a first base player and on this space a card 92, FIG. 7 will be placed, which like the previous one will have on one side the picture or figure of a baseball player, who plays first base and on the other side of the card 4 different groups of plays or moves related with the first base player. The space that follows 40, is for the umpire of first base, is the fifth space in this edge side, which will also have the figure of an umpire printed and on this space we put the device of the umpires 116, FIG. 11, when we have to use the umpires' decisions in a move to see if the player is safe or out. After this space follows the corner 14 and will be for the first base, on this space will not be placed any card, it will shows the words FIRST BASE. This first inside edge side including the first base, will be red painted.

Following the first base 14, to the second base 16, we will have another five spaces, the first space 24, will be for the cards 90 and it will be like others for cards 90, explained before. Afterwards it follows the second space 42, which will be for the one who plays the right field, printed a figure of a baseball player, where we put a card 92, with a figure or picture of a baseball player (right field) on one side and 4 different groups of moves or plays on the other side of the card. The next space 26, this space will be for a card 90, and it will be like the others for cards 90, explained before. The next space 44, is the fourth in this side and will be for the second base player, with a simulated baseball player printed and where we put a card 92, with a picture or figure of a second base player on one side and 4 different groups of plays or moves on the other side of the card. The fifth space 46, will be for the umpire of second base, with a figure of an umpire printed and where we put the plastic device 116 FIG. 11, for the umpires' decisions any time we need it, to find the safe or out in the moves of the same related with the umpires. Afterwards follows the corner which will be for the second base 16, with the words SECOND BASE, printed on it. This second inside edge side including the second base, will be blue painted.

Following the second base 16, to the third base 18, it will be the same as the previous one, the first space 28, where we put a card 90, with different moves for the game. The second space 48, will be for the center field player, with a simulated baseball player printed (center field) where we put a card 92, with a picture or figure of a baseball player, on one side and 4 different groups of moves or plays for the game on the other side of the card. The third space 30, with some words printed like, OUT, HIT, HOME RUN, etc., will be for another card 90. The fourth space 50, will be for the short stop player, with a printed figure of a simulated baseball player, and where we put a card 92, with different moves for the game, related with the short stop player. The fifth space 52, will be for the umpire of third base and will be like the previous one and related to the third base. After this space, follows the corner 18, and will have printed the words THIRD BASE, this third inside edge side including the third base will be yellow painted.

Next from base 18, to home plate 12, it will be the same as th e previous one, the first space 32 and the third space 34, will be for the cards 90, respectively, the third space 34, with the word FOUL printed. The second and fourth spaces 54 and 56 respectively, will be for the cards 92, with figures of baseball players printed, where we put the cards with photos or figures of baseball players and rules for the game on each card. The fifth space 58, will be for the umpire of home plate 12, with a printed figure of an umpire, where we put the plastic device 116 FIG. 11, any time we need the decision of the umpire. Afterwards the fourth corner of the game board 10, will be for the HOME PLATE 12, printed this words, this fourth inside edge side and home plate will be green painted.

Figure 4:
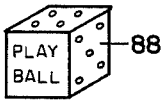
FIG. 4. A perspective view of the die used by the participants in the play of the game.
Figure 5:
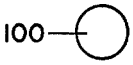
FIG. 5. A perspective view of the small ball used by the participants in the play of the game.
Figure 14:
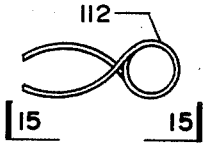
FIG. 14. A view of the spring that makes the special plastic devices rotate
Figure 13:
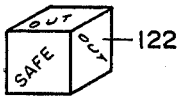
FIG. 13. A view of the die used in FIG. 12.
Figure 22:
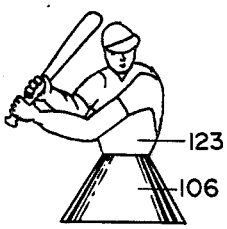
FIG. 22. A view of the batting device.
Figure 23:
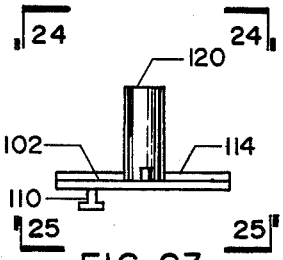
FIG. 23. A view of the device 102, that goes together with 106 in FIG. 22.
Figure 24:
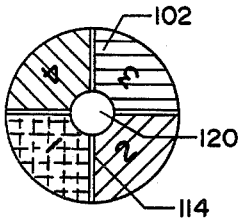
FIGS. 24 and 25. A view of each side, the bottom and the upper side of the device 102 in FIG. 23.
Figure 25:
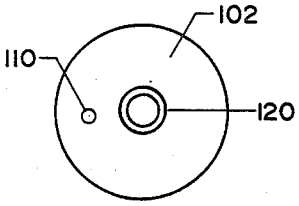
Figure 26:
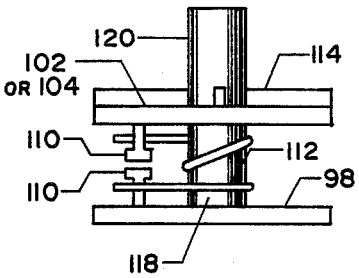
FIG. 26. A side view of the devices 98 and 102 or 104, working together and FIG. 27. A view of the different parts that makes possible the pitching device or the batting device works.
Figure 27:
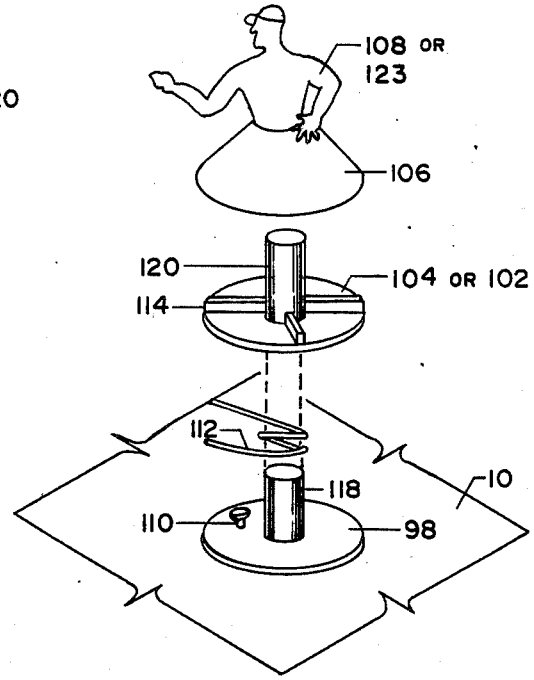

One will find the batting device FIG. 22, at home plate which will shake the die 88, FIG. 4 and the small ball 100, FIG. 5, inside the plastic cover 106, FIG. 22. This batting device FIG. 22 FIG. 13, is formed by: a plastic base 98, with the pin 118 in the center, (that goes inside the piece 120, when we use the special plastic device 60) and a small pin 110, apart from the center of such base 98, both pins will be inserted through the game board 10, a plastic base or bottom 102, with a piece 120, (hollow) in the center of the base 102 and on the other side of the base a small pin 110-A same as pin 110, both work with the spring 112, which will be around the piece 120, and the two ends (of the spring) joiintly to the pins 110 and 110-A respectively, and the piece 120 in the base 102, will be over the pin 118, in order to make the rotation move that will make the die 88 and the small ball 100, jump and change their positions every time we use the batting device; both pins 110 and 110-A are apart from the center of the bases 98 and 102 or 104 respectively, with different radius measure so will not hit each other when with the spring 112, FIG. 14, the to batting device or pitching device, respectively, make the rotation move, actioned by the participants in the game; the bottom or base 102, is divided in four equal parts, numbered from 1 to 4, respectively, with a light border 114, in the equally divided portions and painted with four different colors, the same colors of the four inside edge sides in the game board 10; a transparent plastic cover 106, and a simulated baseball player (batter) on top. This cover 106, will be tied together with the base or bottom 102, in order to make the rotation move at the same time when the to batting device, FIG. 22 is actioned, the spring 112, under the base 102, with the small pin 110 fixed in the base 98, and the small pin 110-A fixed in the base 102, will make a fast movement to the base 102, and the die 88 and the same ball 100, will jump by the four light borders 114, then the colored quadrant where the small ball 100 stops, will be the color on the edge side of the game board 10, where the play or move will be made. The die 88 will give the number of the space on the edge side of the game board 10, where the play or move is going to take place and the number (one of the four on bottom or base 102) where the die 88, stops will be the number chosen in the card (90 or 92) on its back to see which move the player (batter) should make. The die 88, will have five sides with numbers from 1 to 5 respectively and the sixth side will show the name of the game PLAY BALL, when this side of the die 88 shows up, the batter will repeat the play.

Figure 3:
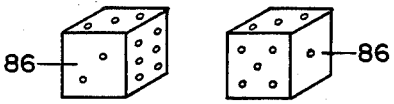
FIG. 3. A perspective view of the dice used by the participants in the play of the game.
Figure 12:
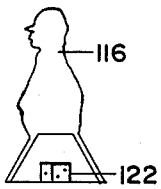
FIG. 12. A section view for the umpires' device.
Figure 15:
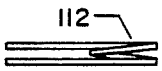
FIG. 15. A side view of the spring, explained in FIG. 14.

In the center of the game board 10, one find the space for the pitcher, where the pitching device, will be placed and it will have two dice 86, FIG. 3, inside the plastic cover 106, which will be moved by a fast movement, like in the batting device, explained before. The pitching device FIG. 12, will be alike the batting device, with a difference in the bottom or base 104, this will have just one color, instead of four colors in bottom or base 102, FIG. 13, and without numbers, just will be divided in four by the light borders 114, ( to make the dice 86, FIG. 3, jump) and a simulated baseball player (pitcher) 108, FIG. 16, on top of cover 106. The cover 106, will be tied together with the bottom or base 104, like in base 102, in the batting device FIG. 22.

From the space occupied by the special plastic device 62 and in direct line toward home plate, there will be eleven small circles. Inside the corner 12 (home plate) will be three small circles 66, and at the same time this circles 66, will be inside of an ellipse 64, that will indicate or will have printed the word BATTING, meaning that whichever one of the three round plastic pieces 94, FIG. 8, placed on the three small circles 66 and if when moving the pitching device, FIG. 62, the number given by the dice 86, (that is the sum of the two dice 86) is the same as one of these three numbers, this will means that the player or participant will go to bat, in this case the simulated batter 108-A, on the batting device, FIG. 22, which is in home plate 12, will be in action with a rotate movement and then we look the numbers and color in the die 88, and the base 102, inside the plastic cover 106. FIG. 22, in order to make the play or move, etc. Following from home plate toward the pitcher, one will see one small circle 70, inside of an ellipse 68, marked OUTS, and this means that when one move the special plastic device 62, the number given (sum of the two dice 86, FIG. 3) being the same as the number of the round plastic piece 94, which is located or placed on the small circle 70, it will be out (the batter). To mark the outs, one will use the pins 96, FIG. 10, and they will be placed inside of the ellipse 68, in such a way that they will stay inserted on the game board 10. Next there will be three circles 74, inside of an ellipse 72, and will indicate STRIKES, this means that a play made with the pitching device, (we already know the procedure) the number from the sum of the dice 86, if it is the same as one of the numbers of the round plastic pieces 94, that we put over the small circles 74, this play will be STRIKE. To mark down these plays, pins 96, FIG. 10, will be used and will be placed inside the ellipse 72, inserted in the game board 10, in small holes destined for this purpose and by doing this way its marks gives us how the game stands at any moment. Lastly, another group of four small circles 78, inside the ellipse 76, will be for the BALLS, for these plays we use the same procedure as explained before for the outs, strikes, etc. The ellipses will have different colors and the small circles will simulate baseball balls and so the plastic round pieces 94, FIG. 8. (numbered from 2 to 12 respectively), with the numbers at the center, and they will be placed over the small circles.

Figure 10:
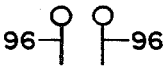
FIG. 10. A view of a plurality of pins, used in the game.

At the inner section of the game board 10, where a stright angle is formed with the edge sides of first base 14, to second base 16 and to the third base 18, next to second base, a simulated scoreboard 82, will be placed, printed with spaces for the nine innings to score the game's runs of the two teams or participants and it will have the shape of a triangle, also in the right angle that forms the design of the scoreboard 82, there will be a drawing of a simulated baseball ball 80 and in its center the name of the game PLAY BALL printed, this space which will be a little hollow in its center, will be designated to deposit the pins 96 FIG. 10, which will be used to score the runs, outs, balls and strikes of each team or participants in the game.

PLAY OF THE GAME

Figure 2:
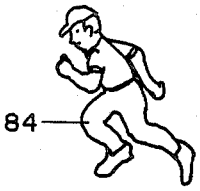
FIG. 2. A plan vieiw of a typical simulated baseball player, used by the participants in the play of the game.

Each participant or team receives one set of 4 simulated baseball players 84, FIG. 2, (2 sets, one color for each set) and a plurality of pins 96, FIG. 10, with a simulated small ball on one end of the pin and placing such pins inserted in the game board 10, FIG. 1, in small holes destined for this purpose in the different ellipses of the game. The pins 96, will be deposited in the circular space 80, with a simulated baseball ball printed in the center and also with the name of the game PLAY BALL.

Figure 6:
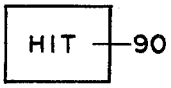
FIG. 6. A view of one group of cards used in the game by the participants.
Figure 7:
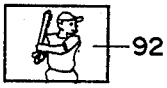
FIG. 7. A view of one group of cards used in the game by the participants.
Figure 8:
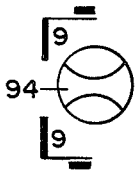
FIG. 8. A view of the small round plastic pieces, used by the participants in the game.
Figure 9:
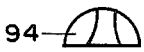
FIG. 9. A view of a simulated baseball ball used in the game by the participants.
Figure 11:
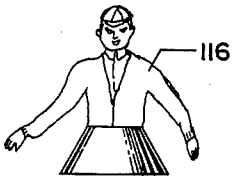
FIG. 11. A view of the device for the umpires' decisions, with a die inside with (3 sides OUT and 3 sides SAFE) and a simulated umpire on top of the plastic box.

To start the game, the two groups of cards 90 and 92, FIGS. 6 and 7, respectively, will be placed on their respectives spaces; also the round plastic pieces 94, FIG. 8, numbered from 2 to 12 respectively, will be placed on the small circles 66, 70, 74 and 78, that are in direct line between the pitcher position 62 and the batter position 60, these plastic round pieces 94, can be placed with running numbers or skipping and one can change them any time we wish (the team or participants playing the simulated field); the batting and pitching devices respectively. respectively, will be placed in their positions, for the batter and the pitcher; the device 116, FIG. 11, for the umpires' decisions and the simulated baseball ball 94, FIG. 9, to be put in the space where the move or play is taken place in the game.

Once all the conditions for the game are prepared, one will proceed to decide which team or participant will be the first going to bat, in other words, the VISITORS, when all this are set, the game starts, "PLAY BALL". The team or participant (HOME CLUB) will be the first to use the pitching device, FIG. 16, (simulating the pitcher) and with a rotate movement the dice 86, FIG. 3, jump and the sum of the two dice will be the number to locate, the round plastic piece 94, FIG. 8, with that number placed on one of the eleven small circles between the pitcher and the batter, once we find the number, one sees if it fell on the group of BALLS, STRIKES, OUTS or BATTING, respectively and then we put (in the space or ellipse in which that group belongs) the pins 96 FIG. 10, to score the play or move, and placing such pins inserted in the game board, in small holes destined for this purpose in the different ellipses of the game.

When the play of the pitching device, falls in the space or ellipse that says BATTING, then the player will operate the to batting device, FIG. 22. (in home plate) and while doing this, the die 88 and the small ball 100, FIG. 5, will jump on the bottom or base 102, inside the plastic cover 106, in such batting device, the bottom or base 102, which is divide in four equal parts, numbered from 1 to 4, respectively and colored with the same four colors of the four edge sides of the game board 10, FIG. 1, simulating the infield; in the bottom or base 102, we will see first, on which color did the small ball 100 stops, this will give the side of the simulated fiel where the play will take place (between home plate and first base, first base and second base, etc.) according to the color being the same as to one of the sides of the field; later one sees which number the die 88, has and the simulated ball 94 FIG. 9, will be moved to the corresponding space on the side of the field where a play or move will take place, according to the color being marked by the small ball 100 and lastly one sees in which number die 88, fell at the base 102, and this will be the number to see in the back of the card, (90 or 92) for the play or move indicated. The base or bottom 102, on each of its 4 divided sections (where those met) has a small elevation 114, to make the die 88 and the small ball 100, jump and change their positions when the rotate movement is made in the batting device, FIG. 22.

As we explained before the cards 90, FIG. 6, will have 8 cards: two cards with the word FOUL, two cards with the word OUT, one card with HIT, one card with 2B, one card with 3B and one card with HOME RUN, all this words will be printed with big letters on one side of the card and on the other side 4 different moves related with the principal move or play. The cards 90, (except the two cards FOUL) could be changed their position between them by the teams or participants, always before using the batting device. The team or participant (batter) will be the first to make the change (just one) then the team or participant (pitcher) will make his change (just one too). When the team or participant (batter) makes a change, the team or participant (pitcher) can not makes his change with the same card the batter did. Every time the participants use the batting device, there is not obligation to make the changes expalined before. When batting device shows the number of the space with the card OUT, this means that the batter hit a fly, right to the player near the space OUT and of course he made him (batter) out, then if there is any player already in bases, we look the other side of the card to see what move could be done basides the out of the batter. As explained before the die 88 in the special plastic device 60, will have 5 sides with numbers from 1 to 5 respectively and the sixth side with the name of the game PLAY BALL and when this side shows up in die 88, the batter will repeat the play.

As we explained before, the cards 92, FIG. 7, will have printed simulated baseball players, or could be real photos on one side and 4 different groups with 4 different moves each group on the other side of the card. The four groups are: first group, when there is no player in bases; second group, when there is one player in bases; the third group, when there are two players in bases and the fourth group, when there are three players in bases. If in the batting device, the play or move is in the infield, the players in bases just could try to run one base. When the move or play in the batting device, is in the outfield (right, center of leftfield) the players will just try to run one or two bases depending with the players in bases and the move or play indicated in the back of the card. To point out the runs of the ball in a move or play, we put the simulated baseball ball 94, FIG. 9, in the space where the batting device, (with the simulated batter) indicates. When the player using the batting device, (with the die 88 and the small ball 100) the move or play goes to the HIT or 2B spaces, we do not use the umpire's decision with this player, because he has the right to be in first or second base respectively, but the others players in bases will use the umpires' decision in the bases where they try to arrive. In either one of the four spaces printed for the umpires, we put any time we need the decision (one at a time) the plastic device 116, FIG. 11, used for the umpires' decisions, which will have a die 122, inside the plastic cover, with one simulated umpire on top, simulating the umpire's positions SAFE or OUT. The die 122 will have 3 sides with the word SAFE and 3 sides with the word OUT. Shaken the plastic device 116, any time we use it, the die 122 will change the position.

If in the batting device, FIG. 22, the batter gets the space of the umpire of first base and there is no player in first base, the batter repeat the play. If there is one player in first base, then we look the decision of the umpire with the plastic device 116, this mean that the player in first base was moving to far from the base and the catcher throws the ball to first base to try to make him out, after this the batter repeat the play (of course if there is not 3 outs after this play).

If the play or move is to the umpire of second base and there is no player in second base or first base, the batter repeat the play. If there is a player in first base we suppose that this player runs to the second base and the catcher throws the ball to second base to try to make the runner out, then we look the umpire (plastic device 116, FIG. 11, that we put in the space for the umpire of second base, to see if the player is out or safe. If there is one player in second base we look the umpire of second base too, this means that the player was out the base and the catcher throws the ball to second base to try to put him out, in all this moves or plays the batter repeat the play.

If in the batting device, FIG. 22, the batter marks the umpire of third base and there is no player in third base or in second base, in this case the batter repeat the play. If there is one player in third base, we look for the umpire's decision in the plastic device 116, that we will put on the umpire of third base after we shake the die 122 inside the plastic device 116, to see if the player is out or safe, because the player was to far from third base and the catcher throws the ball to third base to put him out (try). If there is one player in second base and empty the third base, we look the umpire of third base, this means that the player of second base runs to third base and the catcher throws the ball to third base, as explained before, we shake the device 116, FIG. 11, with the die 122 inside and see the simulated decision of the umpire of third base and then the player will be safe or out. If in second and third bases we have players, we just look the third base umpire, to find out if the player in third base is safe or out. In all this moves or plays the batter repeat the play, of course if there is not 3 outs after this move, as we explained before.

If the umpire of home plate is the move or plat of the batter in the batting device, FIG. 22, and there is no player in third base, the batter repeat the play. If there is no player in third base, we look the umpire of home plate, this means that the player was out of third base and he decided to runs to home plate and the catcher will try to make him out, the simulated umpire of home plate with the plastic device 116, FIG. 11, will give the answer . . . SAFE . . . or . . . OUT.

The cards 90, with the word FOUL, on one side of the card, will have on the other side 4 different moves like: 1. To the stands, 2. Between the foul line and the stands, 3. Back of home plate, to the stands and 4. Between home plate and the stands. When we get the number 2, we look the umpire of first base or third base respectively, if the foul is to the right or to the left line. If we have safe in the umpire's decision, means that the player of the other team did not catch the ball. In the number 4 of the card we look the umpire of home plate. If in the move or play we have the numbers 2 or 4 in the foul card and the die and the small ball in the batting device, stop in a same number or color of the base 102, this means that the batter did not hit a fly, so we do not have to look to the umpire, because the ball hits the ground.

In the ellipse for the ball with the 4 small circles, each circle will say for example, low ball, high ball, outside ball and inside ball respectively. When the two dice in the pitching device, FIG. 16, stop in a same quadrant of the base 104, and the sum of the dice give a number same as one in the ellipse 76, that ball, either one in the 4 small circles 78, will be a wild pitch, the players in bases (runners) will try to reach the next base and of course we look the umpire's decision in the base where the player arrive, the same base where the catcher trows the ball (just in one base).

In the ellipse 72, for the strikes, the small circle in the center will say strike right in the middle, the others two circles will say, for example: outside corner and inside corner, respectively; also if the first strike goes to the small circle nearest the batter, then this will be a swing the bat strike, this position could be changed if both teams or participants agree. If the batter has two strikes and in the third strike, the 2 dice stop in the same quadrant of the base 104, this means that the catcher drops the ball and the batter can run to first base and we look the umpire of first base, because the catcher will throw the ball to first base, trying to make him out.

Figure 16:
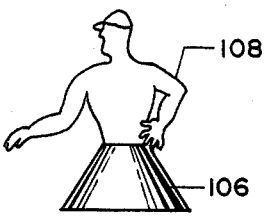
FIG. 16. A view of the pitching device.
Figure 17:
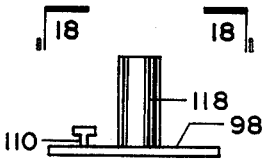
FIG. 17. A view of the device 98, that goes attached to the game board.
Figure 18:
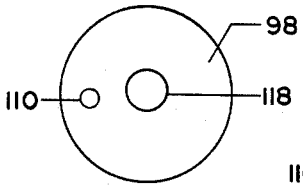
FIG. 18. Another view of the FIG. 17.
Figure 19:
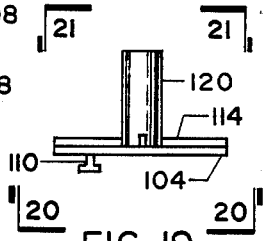
FIG. 19. A view of the device 104, goes together with 106 in FIG. 16.
Figure 20:
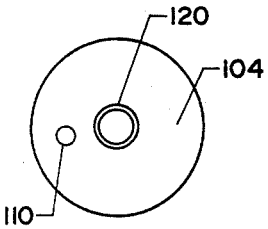
FIG. 20. A view of the device 104, FIG. 19, the bottom.
Figure 21:
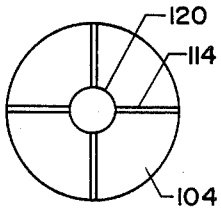
FIG. 21. A view of the device 104, FIG. 19, the upper side.

In the ellipse 68, for the outs, the small circle 70, will have a round plastic piece 94, FIG. 8 (as we do in all the others small circles) with a number and when in the pitching device, FIG. 16, the sum of the dice is the same as in the round plastic piece 94, then the batter is out, this means that the batter for example: hit a fly and the pitcher catch the ball.

The team or participant who is batting (in any moment of the game), will be the one who puts the simulated baseball ball 94, FIG. 9, in the space where the batting device, FIG. 22, point out, then the other team or participant who is pitching, will be the one to simulate the throw of the ball to the bases and use the plastic device 116, for the simulated umpire's decision and see if the player is SAFE or OUT.

Obviously, the above rules for playing the game may be changed or varied, without departing from the true spirit of the game as defined in the appended claims.

What is claimed is:

1. A baseball game apparatus comprising, (a) a game board, (b) a representation of a baseball diamond on said game board comprising four base spaces each of a different color and a group of intermediate spaces between each of said base spaces, means marking each of said groups of spaces being marked with the same color as one of bases, each color of a base being represented, (c) a space to represent the pitcher's location on said game board, (d) eleven marked spaces on said board, in four groups for designating possible pitching plays, (e) eleven markers each bearing a different identifying indicia for placement on said eleven marked spaces, (f) a pitching device comprising means for randomly selecting one of said eleven indicia, (g) a first distinguishable group of cards for individual placement on selected ones of said intermediate spaces and having on one side thereof indicia designating a plurality of plays of the game, (h) a second distinguishable group of cards for individual placement on selected others of said intermediate spaces and having indicia designating a plurality of groups of plays of the game and, (i) a batting device having means for randomly selecting one of said four colors for selecting a group of intermediatespaces and for selecting a particular one of said spaces, and for selecting a particular one of said play indicia on the card on that space.

2. A baseball game as recited in claim 1, further comprising means for simulating a baseball for placement on a space selected by said batting device.

3. A baseball game as recited in claim 1, further comprising an unpire device for placement on a selected one of each of said group of intermediate spaces including means for randomly selecting between an indicia representing an out play and an indicia representing a safe play.

* * * * *